United States Patent [19]

Strobe et al.

[11] 3,977,561

[45] Aug. 31, 1976

[54] CAN END WITH NONDETACHABLE TEAR TAB AND OPENING RING

[76] Inventors: Carl J. Strobe, 2831 Orchard Knob, Atlanta, Ga. 30339; Robert A. Wells, 4450 Harris Trail NW., Atlanta, Ga. 30327

[22] Filed: Sept. 29, 1975

[21] Appl. No.: 617,931

[52] U.S. Cl. ..... 220/269; 220/90.6

[51] Int. Cl.[2] ..... B65D 41/32

[58] Field of Search.... 220/267, 268, 269, 270–273, 220/90.6

[56] References Cited

UNITED STATES PATENTS

| | | | |
|---|---|---|---|
| 3,744,667 | 7/1973 | Fraze et al. | 220/269 |
| 3,795,342 | 3/1974 | Ashton | 220/269 |
| 3,843,011 | 10/1974 | Perry | 220/269 X |
| 3,860,143 | 1/1975 | Stroke et al. | 220/269 |

*Primary Examiner*—George T. Hall
*Attorney, Agent, or Firm*—Jones, Thomas & Askew

[57] ABSTRACT

An easy opening container having a wall in which a tear tab is formed which is nondetachably removable from the wall. An opening tab lies alongside the wall with a nose portion overlying the tear tab, and with a handle portion lying alongside the wall at a location spaced from the tear tab portion. The opening tab is nondetachably connected to the wall by a bendable member having a bend line which permits the handle portion to be moved away from the wall, so that the nose portion moves inwardly into contact with the tear tab. The bendable connection between the handle and the wall remains on the wall at all times, and the opening tab is provided with means which permit only a limited extent of the opening tab to enter into the opening defined by tearaway and inward bending of the tear tab. An air vent into the opened container is provided.

10 Claims, 7 Drawing Figures

CAN END WITH NONDETACHABLE TEAR TAB AND OPENING RING

This invention relates in general to easy opening containers and in particular to easy opening containers in which tear tabs or other elements remain attached to the opened container.

It has become increasingly desirable to provide easy opening containers, and especially containers of the well-known "pop-top" type used extensively for beverages, with an opening structure which cannot become separated from the container during opening. The need for proper disposal of the tear tabs which become completely removed from the easy opening containers in present use, as well as the litter created by improper disposal of such tear tabs, would be eliminated or substantially reduced by the availability of an effective and economical easy opening structure which does not become detached from the container when opened.

Although numerous attempts have been made to provide an easy opening container which eliminates disposable tear tabs without compromising the utility of the container, such prior attempts are not known to have met with commercial success. U.S. Pat. No. 3,674,172, for example, discloses an easy opening container in which the tear tab and pull ring are completely removed from the can during opening, after which the tab is inserted into the can and the connected ring is secured in place over the opening in the can. This construction, while effective is properly used, still gives a person the option of improperly discarding the tear tab, since the tab becomes completely detached from the container during opening.

Numerous prior art attempts have been made to construct an easy opening container in which the pull ring or handle, which must be grasped and manipulated to open the container, remains secured to the tearaway tab by a rivet or other means. The tear tab typically remains attached to the opened container, so that neither the ring nor the tab becomes separated from the container when opened. Numerous technical problems, such as increased cost, manufacturing difficulties, and troublesome operation, have prevented the commercialization of such containers.

Stated in general terms, the present invention comprises an easy opening container with a tear tab nonremovably defined in a wall of the container by a weakened region, and with an opening member attached to the container wall at a location separate from the tear tab. The opening member, which normally lies flat against the wall, is attached to the wall by a bendable member. The opening member has a portion which extends over the tear tab, and which is forced against the tear tab when the handle is pivoted around the bend portion. The opening member is provided with means which limits the extent of entry of the handle to the opened container, and which also assists in defining the axis of bending of the handle during opening. The opening member includes a ring handle which becomes aligned with the opening in the container, upon completing the opening operation, so that the ring provides a protective cover substantially completely surrounding the opening for pouring or drinking the contents of the container.

Accordingly, it is an object of the present invention to provide improved easy opening container apparatus.

It is another object of the present invention to provide easy opening container apparatus having improved nondetachable opening structure.

It is yet another object of the present invention to provide easy opening container apparatus in which the tear tab is openable by a handle member which undergoes a defined limited extent of entry into the opening in the container wall.

Other objects and advantages of the present invention will become more readily apparent from the following description of a disclosed embodiment, including the drawings in which.

Figure 1:
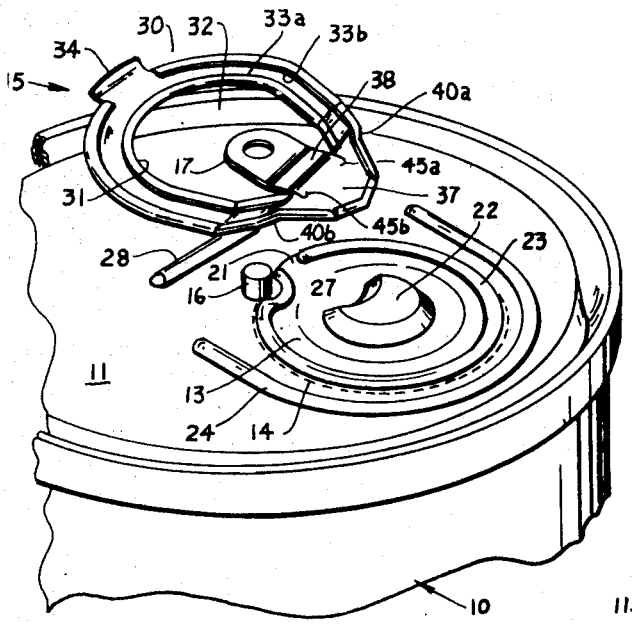
FIG. 1 shows an exploded pictorial view of a container having easy opening end wall according to a disclosed embodiment of the present invention.

Turning to FIG. 1, there is shown generally at 10 a container having an end wall 11 equipped with easy opening structure shown generally at 12. The easy opening structure 12 includes a tear tab 13 which is defined in the end wall 11 by a selectively separable weakened region such as the scoring 14, and an opening member 15 which is nondetachably secured to the end wall 11 by a fastening member such as the rivet 16 or the like extending through the tab portion 17 attached to the opening member.

The score line 14 which defines the tear tab 13 is scoring of the type which becomes completely severed when the tear tab is subjected to displacement force, as discussed below, and the scored region extends around less than the entire periphery of the tear tab so that the bendable hinge connection 21 nondetachably connects the tear tab to the remainder of the end wall 11. It will be understood by those skilled in the art that the bendable hinge connection 21 may be provided by a completely unscored segment of end wall which interrupts the score line 14, or may alternatively be provided by scoring of depth which is less than the depth of the score line 14, so that the tear tab 13 remains connected to the end wall 11 after the score line 14 has become completely severed in the manner described below.

Figure 3:
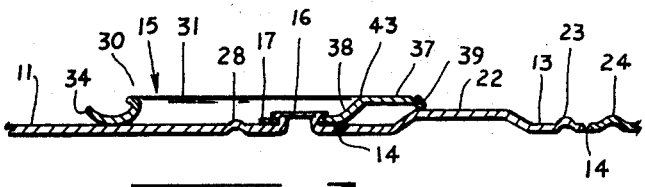
FIG. 3 is a section view taken along line 3—3 of FIG. 2.

As best shown in FIG. 3, the tear tab 13 is formed with a raised area 22 which is elevated above the nominal plane of the tear tab. The raised area 22 may be formed in the tear tab 13 by means of stamping or by any other appropriate metal working operation. The tear tab 13 may also have a raised bead 23 surrounding the periphery of the tear tab in close proximity to the score line 14, to add structural strength to the tear tab for enhancing the severability of the score line. Strength may also be imparted to the end wall 11 surrounding the tear tab 13 by providing a horseshoe-shaped bead 24, if desired, in the end wall.

As particularly shown in FIG. 1, the rivet 16 extends through the end wall 11 to secure the opening member 15 to the end wall at a location which is closely proximate to the tear tab 13, but which remains on the end wall 11 outside of score line 14. The rivet 16 is actually located on a peninsula 27 which juts outwardly into the nominally-circular path of the score line 14, so that the score line describes a detour around the peninsula 27. Placement of the rivet 16 as closely as possible to the tear tab 13 enhances the operability of the present open apparatus, as will become apparent. A stiffening rib 28 may be formed in the end wall 11 on the opposite side of the connection location 26 from the tear tab 13, if desired or necessary to add structural rigidity in the end wall.

Figure 2:
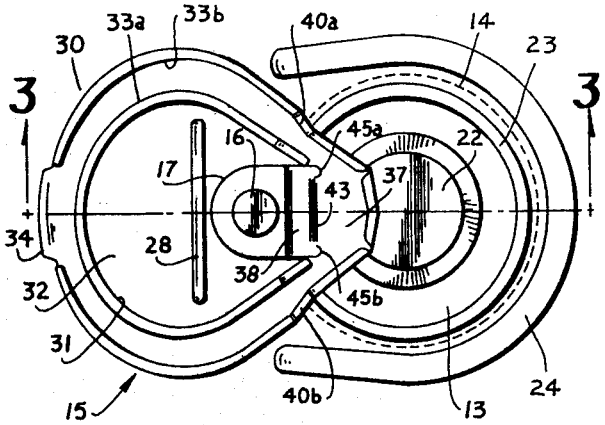
FIG. 2 shows a top plan view of the embodiment in FIG. 1, prior to opening.

The opening member 15 lies against the end wall 11 in closely approximate relation as best seen in FIGS. 2 and 3, includes a handle portion 30 with a generally angular ring member 31 which extends generally rearwardly from the tab portion 17, and which surrounds and defines an opening 32 within the handle portion. The opening 32 preferably has an outline approximately similar to the outline of the tear tab 13 defined by the score line 14, inasmuch as the opening 32 becomes overlaid on the opening 49 provided in the end wall 11 by severing of the score line 14 and displacement of the tear tab 13 away from the end wall 11 and into the interior of the container 10.

Both the inner and outer peripheries of the annular member 31 may be provided with rolled edges **33*a*, 33*b* to add structural rigidity to the handle portion, if desired, and a flange 34 extending rearwardly from the handle portion may be provided to facilitate grasping of the handle portion and initial lifting of the handle portion upwardly away from the initial position shown in FIG. 2, in which the opening member 15 lies alongside the end wall 11**.

Extending forwardly of the connection with the rivet 16, on the opening member 15, is the finger portion 37 which overlies at least a portion of the tear tab 13. As is particularly evident in FIG. 3, the finger portion 37 of the disclosed embodiment is disposed at the upper end of a joggle 38 formed in the tab portion 17, so that the finger portion 37 extends over and above the raised area 22 formed on the tear tab 13. The finger portion 37 terminates in a forward edge 39 which engages the raised area 22 of the tear tab. The rolled edge **33*b* on the outer edge of the ring member 31 preferably extends around the periphery of the finger portion 37, including the forward edge 39**.

Formed at two locations along the outer edge of the opening member 15 are the shoulders **40*a*, 40*b*, which are positioned to engage locations on the periphery of the opening 49 provided by severing and displacement of the tear tab 13**, in a manner described below.

The tab portion 17 is connected to the remainder of the opening member 15 along a bend line 43, which may be defined by any appropriate structural feature such as the upper bend of the joggle 38. The bend line 43 provides a hingeable interconnection between the tab portion 17 and the remainder of the opening member 15, and this hingeable interconnection is further defined and enhanced by the two curls **45*a*, 45*b* which are formed yet the juncture of the bend 44 with the two sides of the tab portion 17. As best seen in FIG. 2, each of the curls 45*a* and 45*b* extends inwardly from the respective sides of the tab portions to provide approximately a semi-circular curl within the metal of the opening member 15. The bend line 43 of the disclosed embodiment is preferably aligned with the two shoulders 40*a* and 40*b***, so that the shoulders and the bend line lie proximately along a common straight line.

Considering the operation of the disclosed embodiment, the handle portion 30 of the opening member 15, which is initially in the flat position shown in FIG. 2, is grasped and moved away from the end wall 11. Movement of the handle portion 30 away from the end wall 11 causes the opening member 15 to pivot about the bend line 43 and force the forward edge 39 of the finger portion 37 downwardly against the tear tab 13, with the result that the score line 34 becomes initially broken and progressively separates around its entire extent. As the handle portion 30 continues to be moved away from the end wall 11 toward the intermediate opening position shown in FIGS. 4 and 5, the finger portion 37 completely displaces the tear tab 13 out of the plane of the end wall 11 and into the container 10 as the tear tab bends about the hinge connection 21. Since the hinge connection 21 is offset relative to the bend line 43 about which the opening member 15 is being rotated, bending mmovement of the tab portion 17 about the bend line 43 is unimpeded by the hinge connection 21 of the tear tab 13. The opening 49 remains in the end wall 11 as the tear tab 13 is severed and displaced away from the end wall.

Figure 4:
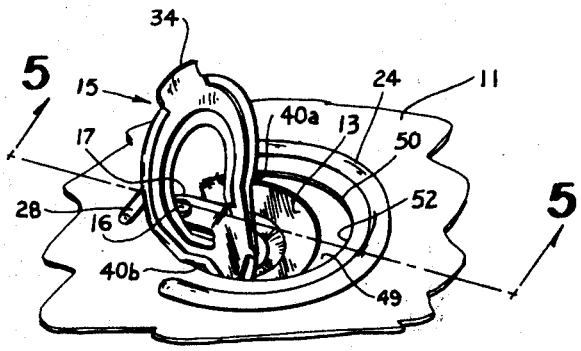
FIG. 4 is a top pictorial view showing the disclosed embodiment as partially opened.
Figure 5:
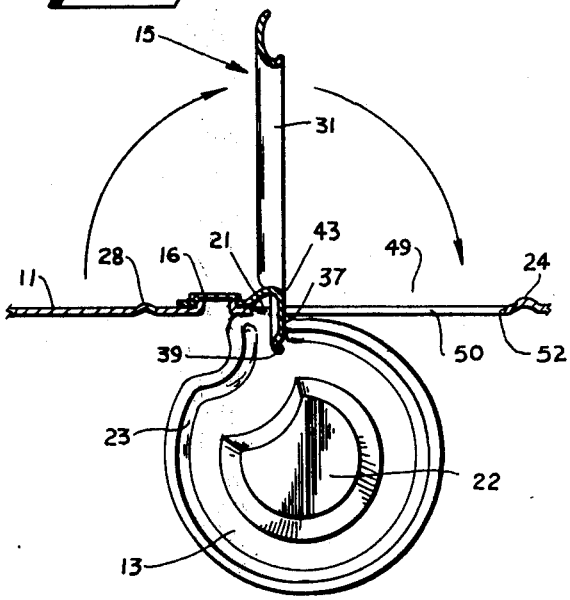
FIG. 5 shows a sectioned elevation view of the disclosed embodiment as partially opened, taken along line 5—5 of FIG.4.
Figure 6:
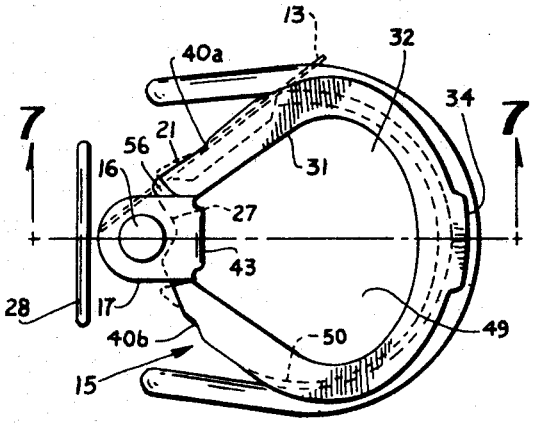
FIG. 6 is a top plan view of the disclosed embodiment as completely opened.
Figure 7:
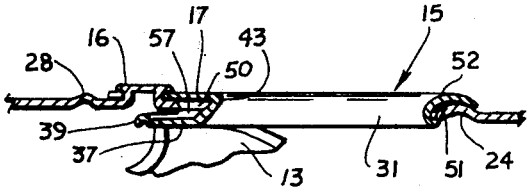
FIG. 7 is a fragmentary section view taken along line 7—7 of FIG. 6.

At some point in the rotation of the opening member 15, such as the half-way point depicted in FIGS. 4 and 5, the finger portion 37 has moved into the opening 49 sufficiently to place the shoulders **40*a* and 40*b* proximately into engagement with confronting locations on the periphery 50 of the opening 49. As the opening member 15 is further rotated about the bend line 43 to complete the easy opening operation, engagement of the shoulders 40*a* and 40*b* with the periphery 50 of the opening 49 prevents further entry of the opening member through the opening 49, and helps define the axis about which the aforementioned further rotation of the opening member progresses. The easy opening operation is completed when the opening member 15 is moved to the position shown in FIGS. 6 and 7, whereat the handle portion 30 lies substantially over the opening 49 provided in the end wall 11 by inward displacement of the tear tab 13. In the fully-opened position, the ring member 31 substantially overlies the periphery 50 of the opening 49 shields any rough edges which may remain on the periphery as a consequence of severing along the scored region 14. The opening 32 within the ring 31 is substantially aligned with the opening 49, so that the contents of the container can be consumed directly from the aligned openings 49 and 32**.

The opening member 15 is preferably retained in the fully-opened view, shown in FIG. 5, by a positive engagement means, such as by a snap-engagement of the lip portion 51 of the ring with the corresponding edge location 52 on the periphery 50 of the opening 49. The ring member 31 of the opening member 15 is accurately aligned with the opening 49 at the conclusion of the opening operation, since the shoulders **40*a* and 40*b* of the opening member define the specific axis of rotation of the opening member and prevent excessive entry of the opening member into the opening 49**.

The open space 56 (FIG. 6) between the inwardly-bent hinge connection 21 and the tab portion 17 of the opened container provides an air vent which is useful when pouring or drinking liquid contents of the container. The open space 57, which remains beneath the folded-over tab portion 17, provides additional air venting into the opening container.

It will be understood that the foregoing relates only to a disclosed embodiment of the present invention, and that numerous alterations and modifications may be made therein without departing from the spirit and the scope of the invention as defined in the following claims.

We claim:

1. A container wall having a nondetachable easy-open portion, comprising:

a wall;

a tear tab defined in said wall in part by a selectively separable predetermined line of weakness and in part by nonseparable hinge means which allows said tear tab to remain attached to said wall when separated along said line of weakness and displaced away from said wall and into a container partially defined by said wall, so that an opening is defined in said wall by the peripheral edge which remains when said tear tab is separated and displaced;

an opening member hingedly connected to said wall at a location on said wall separate from said tear tab;

said opening member having a handle portion which lies alongside said wall at a location spaced apart from said tear tab and which is on one side of said hinge connection of said opening member to said wall;

said opening member having a finger portion extending on the other side of said hinge connection and extending over at least a portion of said tear tab;

said finger portion being positioned to engage and exert force on said tear tab when said opening member is rotated about said hinge connection by moving said handle portion away from said wall, so that said tear tab becomes separated and displaced away from said wall; and means on said opening member to engage said wall as said opening member is rotated about said hinge connection, thereby limiting the entry of said finger portion into opening in said wall.

2. Apparatus as in claim 1, wherein said engaging means on said opening member is positioned on a region of the opening member which enters said opening as the opening member is rotated about said hinge connection, so that said engaging means engages the peripheral wall of the opening defined by said severing and displacement of said tear tab when a predetermined extent of said finger portion has entered the opening.

3. Apparatus as in claim 2, wherein said engaging means on said region of said opening member comprises a pair of shoulder members mounted on said opening member to engage said peripheral wall, with said shoulder members being in spaced apart relation on opposite sides of said hinge connection of said opening member and said wall.

4. Apparatus as in claim 1, wherein:

said hinge connection of said opening member and said wall comprises a bendable tab portion extending from said finger portion to a location on said wall;

means nondetachably securing said bendable tab portion to said wall; and means on said bendable tab portion to define a nondetachable predetermined bend line along which said bendable tab portion bends when said opening member is rotated.

5. Apparatus as in claim 4, wherein said bendable tab portion includes a joggle portion extending upwardly from said securing means to said finger portion which extends over said tear portion, so that said handle portion remains alongside said wall while part of said finger portion extends spaced a distance above said wall and in at least proximate contact with said tear tab.

6. Apparatus as in claim 4, wherein said predetermined bend line is substantially in alignment with said wall engaging means on said opening member so that said predetermined bend line and said wall engaging means cooperate in defining a predetermined line about which said opening tab can rotate.

7. Apparatus as in claim 4, wherein:

said predetermined bend line is on said bendable tab portion in spaced apart relation to said location on said wall so as to overlie said tear portion, so that an air vent opening into the container is formed by open space between said wall location and said bend line when said opening tab is rotated to place said finger portion and part of said bendable tab portion into said opening defined in said wall.

8. Apparatus as in claim 1, wherein:

said handle portion of said opening member comprises annular means defining a ring having an interior opening and disposed alongside said wall at said location spaced apart from said tear tab and on said one side of said hinge connection;

said ring being positioned on said opening member for alignment of said interior ring opening with said opening defined in said wall by separation and displacement of said tear tab when said opening member is rotated around said hinge connection.

9. Apparatus as in claim 8, further comprising:

means for retainingly engaging said ring in said alignment on said wall opening.

10. Apparatus as in claim 1, wherein said nonseparable hinge means is misaligned with said hinge connection of said opening member.

* * * * *